US009528216B2

(12) United States Patent
Jo et al.

(10) Patent No.: US 9,528,216 B2
(45) Date of Patent: Dec. 27, 2016

(54) LAUNDRY TREATING APPARATUS HAVING A DETERGENT SUPPLY MODULE

(71) Applicant: LG ELECTRONICS INC., Seoul (KR)

(72) Inventors: Mingyu Jo, Changwon-si (KR); Dongwon Kim, Changwon-si (KR); Kyosoon Chae, Changwon-si (KR); Naeun Kim, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/022,501

(22) Filed: Sep. 10, 2013

(65) Prior Publication Data

US 2014/0076008 A1 Mar. 20, 2014

(30) Foreign Application Priority Data

| | | |
|---|---|---|
| Sep. 17, 2012 | (KR) | 10-2012-0102811 |
| Oct. 9, 2012 | (KR) | 10-2012-0111707 |
| Nov. 22, 2012 | (KR) | 10-2012-0132842 |
| Nov. 22, 2012 | (KR) | 10-2012-0132843 |

(51) Int. Cl.

| | |
|---|---|
| ***D06F 39/02*** | (2006.01) |
| ***D06F 39/10*** | (2006.01) |
| ***D06F 39/08*** | (2006.01) |
| ***D06F 39/14*** | (2006.01) |

(52) U.S. Cl.

CPC ..... *D06F 39/028* (2013.01); *D06F 39/02* (2013.01); *D06F 39/022* (2013.01); *D06F 39/083* (2013.01); *D06F 39/088* (2013.01); *D06F 39/10* (2013.01); *D06F 39/14* (2013.01)

(58) Field of Classification Search

CPC ..... D06F 39/02; D06F 39/025; D06F 39/10; D06F 58/22

See application file for complete search history.

(56) References Cited

U.S. PATENT DOCUMENTS

| | | | | |
|---|---|---|---|---|
| 3,022,656 | A | 2/1967 | Bergeson et al. | |
| 4,007,546 | A | 2/1977 | Sauer | |
| 4,844,567 | A * | 7/1989 | Chalabian | 312/139 |
| 5,870,906 | A | 2/1999 | Denisar | |
| 2008/0229790 | A1 | 9/2008 | Kim et al. | |

(Continued)

FOREIGN PATENT DOCUMENTS

| | | |
|---|---|---|
| CN | 101479418 A | 7/2009 |
| CN | 101725015 | 6/2010 |

(Continued)

OTHER PUBLICATIONS

International Search report dated Feb. 24, 2014.

(Continued)

*Primary Examiner* — Michael Barr
*Assistant Examiner* — Rita Adhlakha
(74) *Attorney, Agent, or Firm* — KED & Associates, LLP

(57) ABSTRACT

A laundry treating apparatus is provided that may include a cabinet having an introduction port for introduction of laundry and an opening that communicates with an outside of the cabinet, a tub arranged in the cabinet and provided with a tub introduction port that communicates with the introduction port, and a detergent supply module that stores a detergent and provides the stored detergent to the tub, the detergent supply module being detachably provided at the opening.

24 Claims, 13 Drawing Sheets

(56) References Cited

U.S. PATENT DOCUMENTS

| | | | | |
|---|---|---|---|---|
| 2008/0235880 | A1 | 10/2008 | Kim et al. | |
| 2009/0126123 | A1 | 5/2009 | Kim et al. | |
| 2009/0288452 | A1* | 11/2009 | Lee et al. | 68/12.18 |
| 2010/0107704 | A1 | 5/2010 | Seo et al. | |
| 2010/0161143 | A1 | 6/2010 | Smith et al. | |
| 2011/0174021 | A1* | 7/2011 | Lee et al. | 68/17 R |
| 2014/0075684 | A1* | 3/2014 | Kim et al. | 8/137 |
| 2014/0076008 | A1 | 3/2014 | Jo et al. | |
| 2014/0076009 | A1* | 3/2014 | Kim et al. | 68/17 R |

FOREIGN PATENT DOCUMENTS

| | | | |
|---|---|---|---|
| CN | 102066642 | | 5/2011 |
| CN | 102187031 | A | 9/2011 |
| CN | 202744826 | | 2/2013 |
| DE | 24 24 393 | | 12/1975 |
| DE | 88 14 567 | | 9/1989 |
| DE | 10 2008 028 253 | | 1/2009 |
| DE | 10 2008 041 439 | | 2/2010 |
| DE | 10 2008 042 655 | | 4/2010 |
| EP | 0 077 463 | | 4/1983 |
| EP | 0 096 260 | A1 | 12/1983 |
| EP | 0 379 950 | | 8/1990 |
| EP | 1 593 767 | A2 | 11/2005 |
| EP | 1 884 584 | | 2/2008 |
| EP | 2325377 | A1 * | 5/2011 |
| GB | 2 214 524 | B | 6/1989 |
| JP | S50-25056 | A | 3/1975 |
| JP | S52-37711 | | 9/1977 |
| JP | H 01-238898 | A | 9/1989 |
| JP | H 10-33888 | A | 2/1998 |
| JP | H 11-290581 | A | 10/1999 |
| JP | 2007-202685 | | 8/2007 |
| JP | 2009-178195 | A | 8/2009 |
| JP | 2011-19962 | A | 2/2011 |
| JP | 2011-193967 | A | 10/2011 |
| KR | 10-2001-0055716 | A | 7/2001 |
| KR | 10-2002-0000074 | A | 1/2002 |
| KR | 10-2003-0009845 | A | 2/2003 |
| KR | 10-2005-0098521 | | 10/2005 |
| KR | 10-2008-0060705 | A | 2/2008 |
| KR | 10-2008-0089814 | | 10/2008 |
| KR | 10-2010-0048343 | | 5/2010 |
| KR | 10-2010-0081236 | A | 7/2010 |
| KR | 10-1054395 | | 7/2011 |
| KR | 10-2011-0099917 | | 9/2011 |
| WO | WO 2008/120929 | | 10/2008 |
| WO | WO 2008-120930 | A2 | 10/2008 |
| WO | WO 2009/142353 | | 11/2009 |
| WO | WO 2009/142354 | | 11/2009 |
| WO | WO 2011/012468 | | 2/2011 |

OTHER PUBLICATIONS

Office Action dated Dec. 12, 2014, issued in U.S. Appl. No. 14/022,830.
U.S. Office Action dated Mar. 2, 2015 issued in U.S. Appl. No. 14/022,583.
U.S. Office Action dated Apr. 6, 2015 issued in U.S. Appl. No. 14/022,830.
U.S. Office Action dated Jul. 21, 2016 issued in U.S. Appl. No. 14/022,830.
European Search Report dated Nov. 12, 2013.
Chinese Office Action dated Mar. 31, 2016 issued in Application No. 201380048196.5 (with English Translation).
Chinese Office Action dated Feb. 22, 2016 (English Translation).
U.S. Appl. No. 14/943,151, filed Nov. 17, 2015, Rita P. Adhlakha.
U.S. Appl. No. 14/828,593, filed Aug. 18, 2015.
U.S. Appl. No. 14/828,610, filed Aug. 18, 2015.
Korean Notice of Allowance dated Nov. 23, 2015. (English Translation).
U.S. Office Action issued in U.S. Appl. No. 14/022,830 dated Sep. 1, 2015.

* cited by examiner

LAUNDRY TREATING APPARATUS HAVING A DETERGENT SUPPLY MODULE

CROSS-REFERENCE TO RELATED APPLICATION(S)

This application claims priority to Korean Patent Application Nos. 10-2012-0102811, filed in Korea on Sep. 17, 2012, 10-2012-0111707, filed in Korea on Oct. 9, 2012, 10-2012-0132842, filed in Korea on Nov. 22, 2012, and 10-2012-0132843, filed in Korea on Nov. 22, 2012, all of which are hereby incorporated by reference in their entirety.

BACKGROUND

1. Field

A laundry treating apparatus is disclosed herein.

2. Background

Typically, laundry treating apparatuses include a dryer to dry laundry and a washing machine to wash the laundry. The washing machine uses a detergent to wash laundry, and is generally provided with a detergent storage device into which the detergent is introduced.

Hereinafter, a conventional detergent storage device will be briefly described with reference to FIG. 1. FIG. 1 shows a conventional laundry treating apparatus. As shown in FIG. 1, the conventional laundry treating apparatus 1 may include a cabinet 10 that forms an external appearance of the laundry treating apparatus 1 and provided with a door 12 through which laundry may be introduced, a tub 20 provided in the cabinet 10 to contain washing water, a drum 30 rotatably provided in the tub 20 to accommodate the introduced laundry, a water supply device 40 with valve 44 to supply washing water into the tub 20, and a drainage device 60 to discharge the washing water after completion of washing. Such a laundry treating apparatus may be provided with a detergent storage device 50 to simultaneously introduce washing water and a detergent into the tub 20 and the drum 30 to improve the effect of washing of the laundry by the drum 30.

The detergent storage device 50 may be provided with a detergent introduction portion 52 formed in the shape of a drawer partially withdrawable in a forward direction from the laundry treating apparatus 1. When detergent is placed in the withdrawn detergent introduction portion 52 and then the detergent introduction portion 52 is placed back in the detergent storage device 50, the detergent may be supplied to the tub 20 and the drum 30 together with washing water, and the laundry may be washed by the drum 30.

The detergent storage device 50 may be located at one side of an upper portion of the laundry treating apparatus 1. Accordingly, a user must uncomfortably lift the detergent up to the upper portion of the laundry treating apparatus 1 to introduce the detergent into the detergent introduction portion 52.

In recent years, a prop to support a lower surface of the laundry treating apparatus 1 has sometimes further been provided to increase a height of a position of a clothing introduction port (specifically, the door 12). However, adding a prop to the laundry treating apparatus 1 may further heighten the position of the detergent introduction portion, thereby increasing user inconvenience.

The above references are incorporated by reference herein where appropriate for appropriate teachings of additional or alternative details, features and/or technical background.

BRIEF DESCRIPTION OF THE DRAWINGS

Embodiments will be described in detail with reference to the following drawings in which like reference numerals refer to like elements, and wherein.

DETAILED DESCRIPTION

Figure 1:
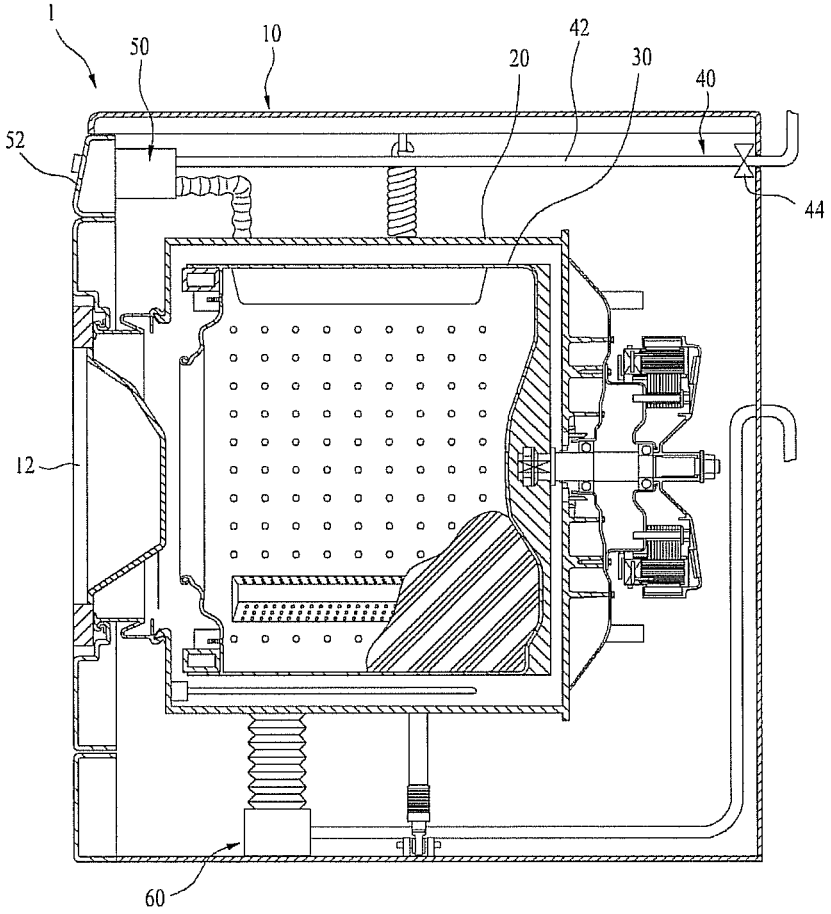
FIG. 1 CONVENTIONAL ART
FIG. 1 is a side cross-sectional view of a conventional laundry treating apparatus.

Reference will now be made in detail to embodiments, examples of which are illustrated in the accompanying drawings. Where possible, like reference numerals have been used to indicate like elements, and repetitive disclosure has been omitted.

Figure 2:
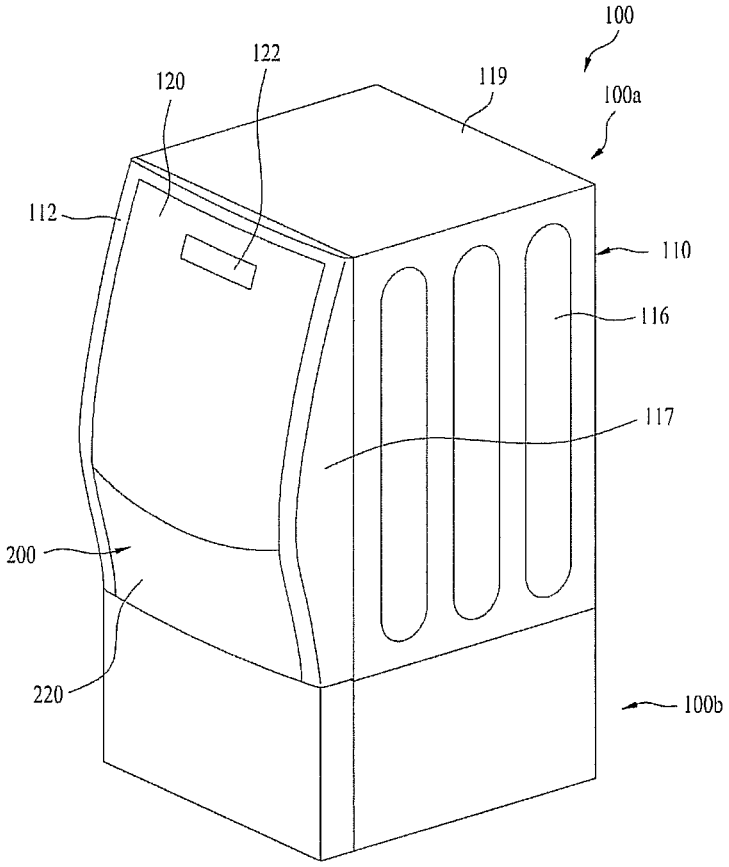
FIGS. 2 to 4 are schematic views of a laundry treating apparatus according to an embodiment.
Figure 3:
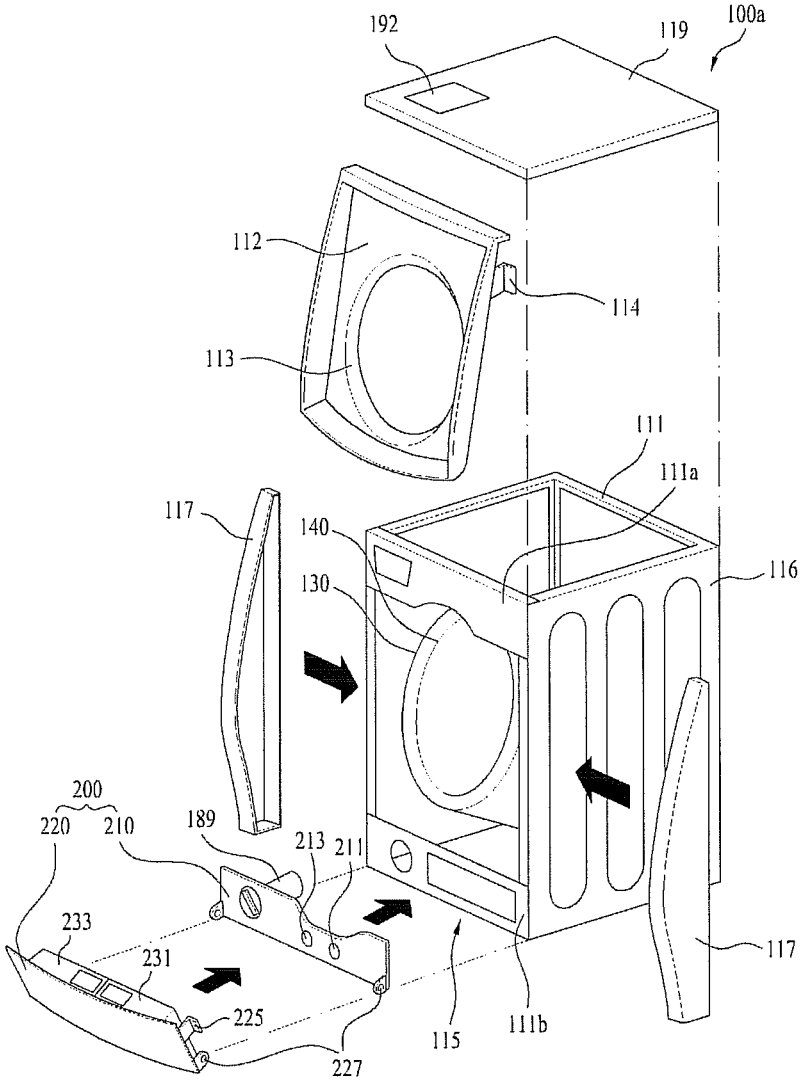
Figure 4:
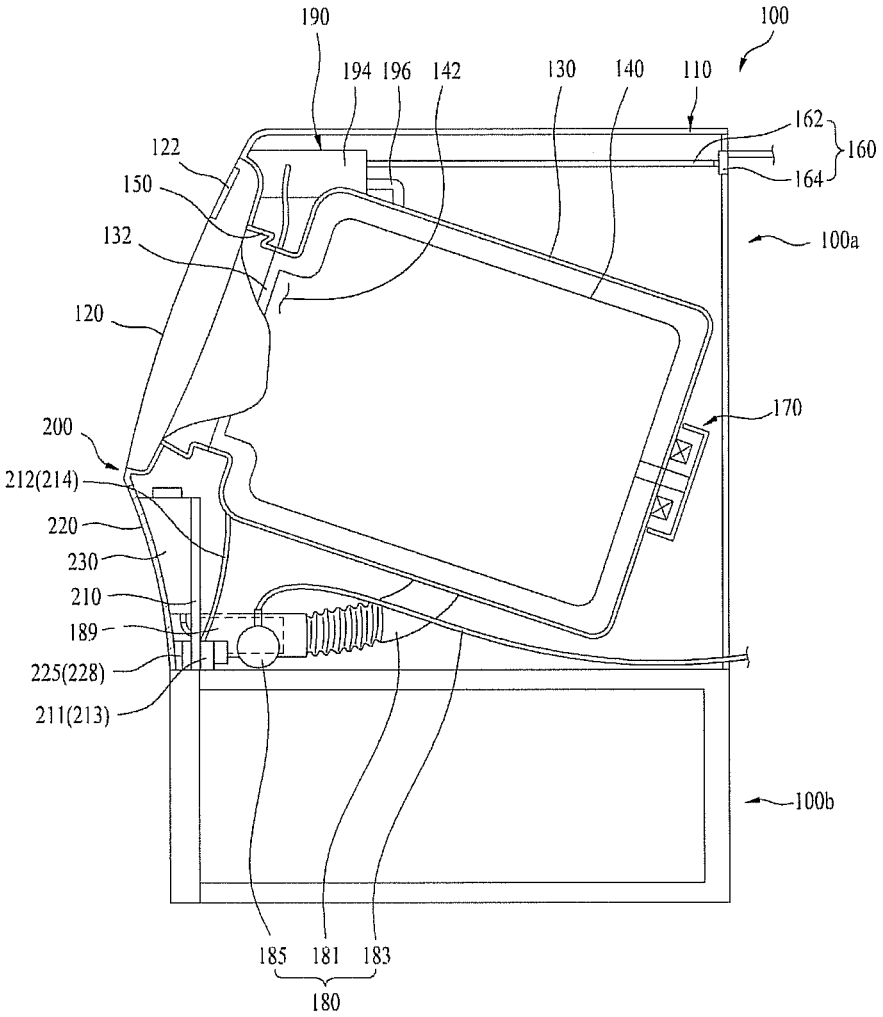
Figure 5A:
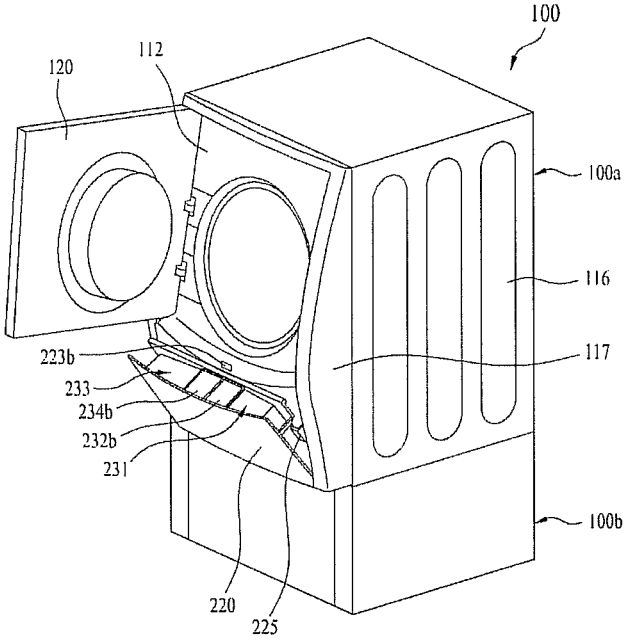
FIGS. 5A, 5B, and 6 are schematic views of a detergent supply module according to an embodiment.
Figure 5B:
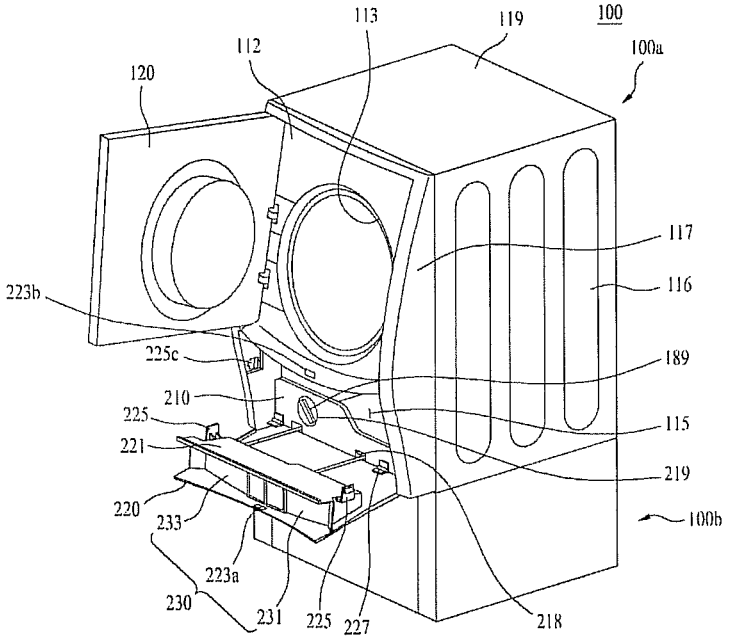
Figure 6:
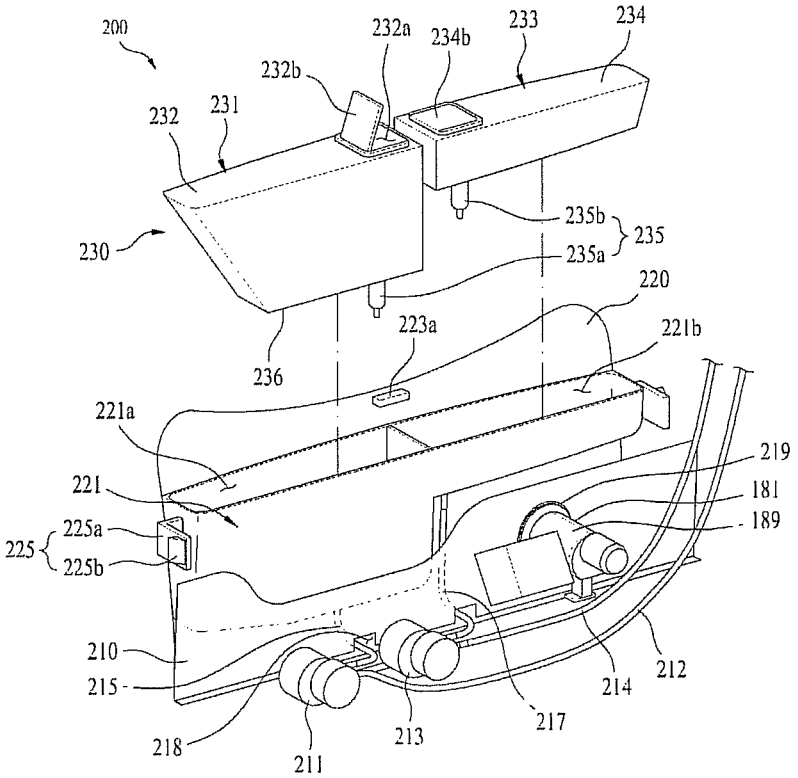

FIGS. 2 to 4 are schematic views of a laundry treating apparatus according to an embodiment. FIGS. 5A, 5B, and 6 are schematic views of a detergent supply module according to an embodiment.

A laundry treating apparatus 100 according to an embodiment may be provided with only a first treating apparatus 100*a* to treat laundry (such as washing and drying), or may be provided with the first treating apparatus 100*a* and a second treating apparatus 100*b* arranged at a lower portion of the first treating apparatus 100*a* to treat laundry (such as washing and drying), as shown in FIG. 2. Hereinafter, a description will be given of the laundry treating apparatus 100 provided with both the first treating apparatus 100*a* and the second treating apparatus 100*b*.

It is noted that the second treating apparatus 100*b* may be arranged at a position other than at the lower portion of the first treating apparatus 100*a*. The second treating apparatus 100*b* may be a device to wash or dry a small amount of laundry. Alternatively, the second treating apparatus 100*b* may simply be an accommodation space to store laundry or a detergent needed to wash the laundry, or may be a simple prop to increase a height of the first treating apparatus 100*a*.

The first treating apparatus 100*a* may include a cabinet 110 that forms an external appearance of the first treating apparatus 100*a*, a tub 130 provided in the cabinet 110 to contain washing water, a drum 140 rotatably provided in the tub 130 to accommodate the laundry, a drive 170 arranged at a back of a tub 130 to rotate the drum 140, a water supply device 160 to supply washing water to the tub 130, a drainage device 180 to discharge washing water from the tub 130, and a detergent supply module 200 to store a detergent and supply the store detergent to the tub 130.

As shown in FIG. 3, the cabinet 110 may include a front panel 112, a back panel (not shown), a side panel 116, and an upper panel 119. In addition, the cabinet 110 may further include a frame 111 by which the panels may be supported. The frame 111 may not be visible from the outside due to the panels 112, 116, and 119.

The frame 111 may be provided with an upper installation surface 111*a* to which the front panel 112 may be fixed, and a lower installation surface 111*b* to which the detergent supply module 200 may be fixed. The upper installation surface 111*a* may be positioned at an upper portion of the frame 111, and the lower installation surface 111*b* may be positioned at a lower portion of the frame 111.

The front panel 112 may be provided with an introduction port 113 to allow laundry to be introduced into the tub 130 therethrough. The introduction port 113 may be opened and closed by a door 120. The door 120 may be provided with a control panel 122 for manipulation of the laundry treating apparatus 100.

The front panel 112 may be inclined in a direction away from the frame 111. That is, the front panel 112 may be arranged such that an upper surface of the front panel 112 may be fixed to the upper installation surface 111*a*, and a lower surface of the front panel 112 may be spaced a predetermined distance from the frame 111.

The front panel 112 may be coupled to the frame 111 such that a lower space 115 (opening) of an inner space of the first treating apparatus 100*a* may be exposed to the outside. The detergent supply module 200 may be provided in the exposed lower space of the front panel 112. Accordingly, a front surface of the first treating apparatus 100*a* may be defined by the front panel 112 and the detergent supply module 200.

The side panel 116 may be fastened to both side surfaces of the frame 111, defining the side surfaces of the first treating apparatus 100*a*. The side panel 116 may be formed in the shape of a rectangular plate. A surface of the side panel 116 that contacts the front panel 112 may be inclined to support the front panel 112.

In the case that the side panel 116 is formed in the shape of a rectangular plate, a support panel 117 to support the front panel 112 may be further provided between the side panel 116 and the front panel 112. The support panel 117 may be coupled to both sides of the front panel 112 to define a space to accommodate the door 120 and a space (opening 115) to accommodate the detergent supply module 200.

The support panel 117 may define a surface that extends parallel with a surface defined by the side panel 116 and may be coupled to both side surfaces of the front panel 112. Alternatively, the support panel 117 and the front panel 112 may be integrated with one another. In this case, the front panel 112 and the support panel 117 may be simultaneously coupled to the frame 111 by a reinforcement member 114, thereby simplifying an assembling process. The reinforcement member 114 may be provided on or at both side surfaces of the front panel 112 to maintain the inclination angle of the front panel 112 and to reinforce attachment of the front panel 112. In this case, the support panel 117 may be fixed to the reinforcement member 114.

As shown in FIG. 4, the tub 130 may be provided with a tub introduction port 132 corresponding to the introduction port 113, and the drum 140 may be provided with a drum introduction port 142 corresponding to the introduction port 113 and the tub introduction port 132. Accordingly, the user may open the introduction port 113 by opening the door 120 and then introduce laundry into or withdrawn the same from the drum 140 through the tub introduction port 132 and the drum introduction port 142.

A gasket 150 may be provided between the introduction port 113 and the tub introduction port 132. The gasket 150 may not only prevent transfer of vibration of the tub 130 to the cabinet 110, but also prevent washing water from leaking from the tub 130.

To facilitate introduction and withdrawal of the laundry, the tub 130 and the drum 140 may be arranged to be inclined at a predetermined angle in the cabinet 110. In this case, the tub introduction port 132, the drum introduction port 142, and the introduction port 113 may be arranged to extend parallel with the inclined surface of the front panel 112. In the case that the inclined surface of the front panel is perpendicular to the rotating shaft of the drum, the inclination angle of the tub 130 and the drum 140 with respect to the ground (or a horizontal line) may be equal to the inclination angle of the front panel 112 with respect to a line perpendicular to the ground.

The door 120 may be rotatably provided to, at, or on the front panel 112 to open and close the introduction port 113, the tub introduction port 132, and the drum introduction port 142.

The drive 170 to rotate the drum 140 may be arranged at the back of the tub 130. The drive 170 may be provided with a stator fixed to a rear surface of the tub 130, a rotor arranged to surround the stator, and a rotating shaft arranged to penetrate the back of the tub 130 to connect the drum 140 with the rotor.

A detergent storage module 190 to store the detergent and to supply the stored detergent to the tub 130 when the water supply device 160 supplies washing water may be further provided in the cabinet 110. The detergent storage module 190 may be provided with a storage body 194 arranged at an upper portion of the introduction port 132 to store the detergent, and a tub supply conduit 196 that allows the storage body 194 to communicate with the tub 130 therethrough. In this case, the water supply device 160 may be provided with a water supply channel 162 to connect a water supply source located outside of the laundry treating apparatus 100 with the storage body 194, and a water supply valve 164 to open and close the water supply channel 162.

The detergent storage module 190 may be formed in the shape of a drawer that allows the storage body 194 to be withdrawable from the cabinet. In this case, the tub supply conduit 196 may need to be formed of a structure or a material that allows a length of the tub supply conduit 196 to be varied.

In the case that the storage body 194 is fixed to an interior of the cabinet 110 and thus is not withdrawable from the cabinet, the upper panel 119 may be provided with a door 192 (see FIG. 3) to open and close the storage body 194.

The detergent storage module 190 may be distinguished from the detergent supply module 200 with regard to installation position and manner of supply of the detergent. That is, the detergent storage module 190 may be positioned at the upper portion of the introduction port 113, while the detergent supply module 200 may be positioned at a lower portion of the introduction port 113. In addition, the detergent storage module 190 may supply the stored detergent to the tub 130 through the water supply device 160, while the detergent supply module 200 may supply the stored detergent to the tub 130 through detergent pumps 211 and 213. Accordingly, detergent may remain in the detergent storage module 190 for a very short time, while the detergent supply module 200 may be capable of storing detergent for a long time. Moreover, the detergent storage module 190 may allow both liquid detergent and powdered detergent to be stored therein, while the detergent supply module 200 may allow only liquid detergent to be stored therein unless a separate detergent dissolving device is provided.

The drainage device 180 may serve to discharge the washing water contained in the tub 130 from the cabinet 110. The drainage device 180 may be provided with a first drainage channel 181 to connect the tub 130 with a drainage pump 185, and a second drainage channel 183 to guide the washing water discharged from the drainage pump 185 outside of the cabinet 110. The first drainage channel 181 may be provided with a filter 189 to filter the washing water flowing to the drainage pump 185. To allow the user to easily remove impurities remaining in the filter 189, the filter 189 may be detachably provided in the first drainage channel 181. Moreover, to allow the user to easily replace the filter 189, the filter 189 may be positioned at or in the opening 115 where the detergent supply module 200 is positioned, a detailed description of which will be provided hereinbelow.

As shown in FIGS. 5A-5B, the detergent supply module 200 may be arranged at or in the opening 115 to store the detergent therein and to supply the stored detergent to the tub 130 through the detergent storage module 190. Alternatively, the detergent supply module 200 may be arranged to directly supply the detergent to the tub 130.

The opening 115 may be defined as the space formed by the support panel 117 provided on or at both side surfaces of the front panel 112 and a lower surface of the front panel 112. In this case, a front surface of the first treating apparatus 100*a* may be formed by the front panel 112 and the detergent supply module 200. In the case that the front surface of the cabinet 110 is formed only by the front panel 112, the opening 115 may be defined as a hole (provided separately from the introduction port 113) formed at the lower portion of the introduction port 113 to penetrate the front panel 112, unlike the view in FIGS. 5A-5B. That is, the front panel 112 may be provided with a first region having the introduction port 113 and a second region positioned at a lower portion of the first region and provided with the opening 115. In this case, the door 120 to open and close the introduction port 113 may be rotatably provided in the first region, and the detergent supply module 200 may be provided in the second region.

In any of the above cases, the detergent supply module 200 may be arranged at the lower portion of the introduction port 113 to open and close the opening 115. Further, the detergent supply module 200 may be provided with a module panel 210 coupled to the lower installation surface 111*b* of the frame 111, a module door 220 rotatably provided to, at, or on the module panel 210, and a container 230 provided to, at, or on the module door 220 to provide a space in which the detergent may be stored. As the detergent supply module 200 is fixed to the first treating apparatus 100*a* through coupling of the module panel 210 to the frame 111, assembly of the detergent supply module 200 may be simplified.

The module door 220, which may serve to open and close the opening 115, may include an accommodation frame 221 coupled to a hinge 227 of the module panel 210 and adapted to accommodate the container 230. The hinge 227 may be provided to couple a lower surface of the module door 220 to the module panel 210, and the module door 220 may be detachable from the cabinet 110 through a first fixing portion 223. The first fixing portion 223 may include a lock 223*a* provided to or at one of the module door 220 or the cabinet 110, and a lock groove 223*b* provided to or at the other one of the module door 220 or the cabinet 110 to accommodate the lock 223*a*. The lock 223*a* and the lock groove 223*b* may be in the form of a push button.

The lock 223*a* and the lock groove 223*b* may be arranged at any position on the module door 220 so long as the above functions are possible. In FIGS. 5A-5B, the lock 223*a* and the lock groove 223*b* are arranged at an upper portion of the module door 220 as an example.

The module door 220 may further include a second fixing portion 225 to adjust an angle of rotation of the module door 220. The second fixing portion 225 may also be arranged at any position on the module door 220 so long as the above function is possible. FIGS. 5A-5B, the second fixing portion 225 is arranged on both side surfaces of the module door 220, as an example.

The second fixing portion 225 may be provided with an extension bar 225*a* (see FIG. 6) that extends from a side surface of the module door 220 toward the opening 115, a protrusion 225*b* that protrudes from the extension bar 225*a*, and a stopper 225*c* provided to, at, or on the cabinet 110 that allows the protrusion 225*b* to be detachably coupled thereto.

The stopper 225*c* may be formed to protrude from an inner circumferential surface of the support panel 117, and the extension bar 225*a* and the protrusion 225*b* may be integrated with one another. At least one of the extension bar 225*a*, the protrusion 225*b*, or the stopper 225*c* may be formed of an elastically deformable material. The extension bar 225*a* may be formed of an elastically deformable material. When the user pushes the module door 220 toward the opening 115 such that the module door 220 closes the opening 115 (for example, with the locker 223*a* coupled to the locker groove 223*b*), coupling between the lock 223*a* and the lock groove 223*b* may be released and the module door 220 may rotate away from the cabinet 110. When the module door 220 rotates away from the cabinet 110, the extension bar 225*a* and protrusion 225*b* of the second fixing portion may also move away from the cabinet 110. Once the protrusion 225*b* is coupled to the stopper 225*c*, rotation of the module door 220 may be stopped, and thus, the module door 220 may maintain a first angle of rotation (a first operation of the module door). The first angle may be set to an angle at which an upper surface of the container 230 provided to, at, or in the module door 220 may remain exposed outside of the opening 115 (see FIG. 5A). When the user pulls the module door 220 away from the cabinet 110 with the first operation of the module door 220 completed, the module door 220 may perform a second operation (see FIG. 5B). When the module door 220 is pulled by the user, the extension bar 225*a* may be elastically deformed, and thereby coupling between the protrusion 225*b* and the stopper 225*c* may be released. Once coupling between the protrusion 225*b* and the stopper 225*c* is released, the module door 220 may be rotated by or to a second angle. The second angle may be set to an angle at which the filter 189 detachably provided to or in the module panel 210 is exposed. In this case, the first treating apparatus 100*a* may be further provided with a second stopper (not shown) to support the module door 220, such that the module door 220 may be maintained at the second angle. The second stopper may be provided to or on the hinge 227 which couples the module door 220 with the module panel 210, or may be provided to or on a plate to support the module door 220 on a lower surface of the cabinet 110. FIG. 5B exemplarily shows the second angle set to an angle at which the module door 220 extends substantially parallel to ground.

Meanwhile, to prevent the module door 220 from abruptly rotating during the first operation and the second operation, the first treating apparatus 100*a* may be further provided with a damper (not shown). The damper may be a cylinder or an elastic member. In the case that detergent is contained in the container 230, the module door 220 may be abruptly rotated due to a weight of the detergent and the container 230. In this case, there may be a risk of the container 230 being separated from the module door 220. The damper serves to address this risk.

When the module door 220 is rotated to the first angle (by the first operation), the container 230 may be exposed to the outside of the first treating apparatus 100*a*, and accordingly, the user may check an amount of the detergent stored in the container 230 a necessity of cleaning of the container. If necessary, the container 230 may be separated from the first treating apparatus 100*a*. If the module door 220 is rotated to the second angle (by the second operation), the filter 189 may be exposed to the outside of the first treating apparatus 100*a*, and accordingly, the user may replace or rinse the filter 189.

The container 230 provided to, at, or in the module door 220 may be adapted to contain only one kind of detergent. Alternatively, the container 230 may be adapted to contain two or more kinds of detergents. That is, as shown in FIG. 6, the container 230 may be provided with a first container 231 to store a first detergent, and a second container 233 to store a second detergent, which may be a detergent of a different kind than the first detergent, or may be provided with three or more containers. In this case, the accommodation frame 221 may be provided with a first accommodation portion 221*a* to accommodate the first container 231, and a second accommodation portion 221*b* to accommodate the second container 233. The first accommodation portion 221*a* and the second accommodation portion 221*b* may be separated from each other by a partition wall that divides an inner space provided by the accommodation frame 221.

The first container 231 and the second container 233 may be detachably provided to the respective accommodation portions 221*a* and 221*b*. In this case, each of the containers 231 and 233 may be provided with a detergent discharge conduit 235 to discharge the detergent stored in the container 231, 233 to the accommodation portion 221*a*, 221*b*.

That is, a bottom surface 236 of the first container 231 may be provided with a first detergent discharge conduit 235*a* to discharge the detergent stored in the first container 231 to the first accommodation portion 221*a*, and a bottom surface of the second container 233 may be provided with a second detergent discharge conduit 235*b* to discharge the detergent stored in the second container 233 to the second accommodation portion 221*b*. The first detergent discharge conduit 235*a* and the second detergent discharge conduit 235*b* may be provided with a structure to discharge the detergent stored in the container 231, 233 to each of the accommodation portions 221*a* and 221*b* when the containers 231 and 233 are respectively inserted into the accommodation portions 221*a* and 221*b*.

An upper surface 232 of the first container 231 may be provided with a first detergent introduction port 232*a* for supply of the first detergent and a lid 232*b* to open and close the first detergent introduction port 232*a*. The upper surface 234 of the second container 233 may be provided with a second detergent introduction port 234*a* for supply of the second detergent and a lid 234*b* to open and close the second detergent introduction port 234*a*.

At least one of the upper surface 232, 234, and the lid 232*b*, 234*b* of each container may be formed of a transparent material. In the case that the upper surface 232, 234 of each container is formed of a transparent material, an entire upper surface need not be formed of the transparent material. That is, at least one area of the upper surface 232, 234 may be formed of the transparent material.

Further, the upper portion of each container 231, 233 may have a larger cross-sectional area than a lower portion of each container 231, 233. In addition, each container may be formed such that a cross-sectional area thereof decreases from the upper surface 232, 234 to the bottom surface 236.

Accordingly, the user may check an amount of the detergent stored in each container 231, 233 and a degree of contamination of an interior of each container through the transparent upper surface 232, 234 or lid 232*b*, 234*b*. In addition, as the upper portion of each container has a greater cross-sectional area than the lower portion thereof, the user may check an entire interior of each container 231, 233 at a glance through the transparent upper surface 232, 234 or lid 232*b*, 234*b*, and thus, invisible zones in the inner space of the container may be eliminated. Further, the upper surface 232, 234 of each container may be detachably provided to each container. This allows rinsing of the interior of each container 231, 233 without separating each accommodation portion 221*a*, 221*b* from the corresponding container.

In the case that a liquid detergent (the first detergent) to remove contaminants from the laundry is stored in the first container 231, and a fabric softener (the second detergent) is stored in the second container 233, a volume of the second container 233 may be smaller than a volume of the first container 231.

As consumption of the second detergent may generally be less than consumption of the first detergent, a volume of the detergent supply module 200 may be minimized where the filter 189 is coupled to the module panel 210, such that it is positioned at the lower portion of the second container 233.

Detergent pumps 211 and 213 to supply the detergents stored in the container 230 to the detergent storage module 190 may be fixed to the module panel 210, to which the module door 220 may be rotatably coupled. Further, the module panel 210 may be provided with a filter attaching hole 219 in which the filter 189 may be detachably accommodated.

The module panel 210 may have any shape which allows the module panel 210 to be coupled to the lower installation surface 111*b*. As the filter attaching hole 219 supports the filter 189 by penetrating the module panel 210, the user may separate the filter 189 from or couple the same to the drainage device 180 through the filter attaching hole 219.

The detergents stored in the respective containers 231 and 233 may be introduced into the detergent pumps 211, 213 through pump connection conduits 215 and 217. The detergents discharged from the detergent pumps are guided to the detergent storage module 190 through detergent supply conduits 212 and 214. In the case that the container includes the first container 231 and the second container 233, the detergent pumps may include first detergent pump 211, which may communicate with the first container 231, and second detergent pump 213, which may communicate with the second container 233.

The first detergent pump 211 may be connected to the first accommodation portion 221*a* through the first pump connection conduit 215, and the second detergent pump 213 may be connected to the second accommodation portion 221*b* through the second pump connection conduit 217. As the containers 231 and 233 are respectively provided with the detergent discharge conduits 235*a* and 235*b* to discharge the detergents to the accommodation portions 221*a* and 221*b*, the detergents discharged from the containers to the accommodation portions 221*a* and 221*b* may be respectively supplied to the detergent pumps 211 and 213 through the pump connection conduits 215 and 217.

The detergent discharge conduits 235*a* and 235*b* may be arranged to directly discharge the detergents to the pump connection conduits 215 and 217. In this case, the detergent discharge conduits 235*a* and 235*b* may discharge the detergents to the pump connection conduits 215 and 217 when the containers 231 and 233 are respectively inserted into the accommodation portions 221*a* and 221*b*.

The detergent introduced into the first detergent pump 211 may be supplied to the detergent storage module 190 through the first detergent supply conduit 212, while the detergent introduced into the second detergent pump 213 may be supplied to the detergent storage module 190 through the second detergent supply conduit 214. Unlike the configuration described above, the first detergent supply conduit 212 may connect the first detergent pump 211 to the tub 130, and the second detergent supply conduit 214 may connect the second detergent pump 213 to the tub 130.

The module panel 210 may be provided with a connection conduit hole 218 which the pump connection conduits 215 and 217 may penetrate. The connection conduit hole 218 may be formed at a lower end of the module panel 210.

The detergent pumps 211 and 213 may be fixed to, on, or at a rear surface of the module panel 210, and the container 230 may be positioned to, on, or at a front surface of the module panel 210 (in the space between the module panel 210 and the module door 220). Accordingly, the connection conduit hole 218 may serve to prevent the pump connection conduits 215 and 217 from being separated from the detergent pumps 211 and 213 when the module door 220 rotates.

In addition, the pump connection conduits 215 and 217 may be formed of a flexible material. The pump connection conduits 215 and 217 may be sufficiently long to connect the detergent pumps 211 and 213, respectively, to the accommodation portions 221*a* and 221*b* even when the module door 220 is rotated to the second angle.

The connection conduit hole 218 may be further provided with a holder (not shown) to fix the pump connection conduits 215 and 217 to the module panel 210. This may serve to keep lengths of portions of the pump connection conduits 215 and 217 positioned between the connection conduit hole 218 and the detergent pumps 211 and 213 constant to prevent tangling of the pump connection conduits 215 and 217 during rotation of the module door 220.

Figure 7:
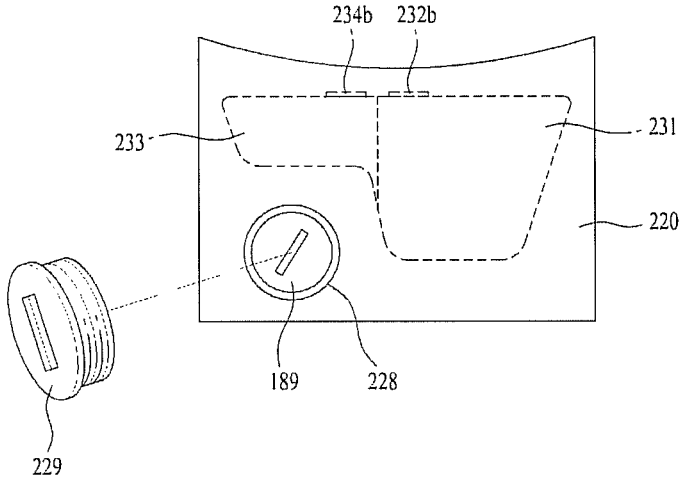
FIG. 7 is a schematic view of a detergent supply module according to another embodiment.

FIG. 7 is a schematic view of a detergent supply module according to another embodiment. In the first treating apparatus 100*a* provided with the detergent supply module 200, the filter 189 may be separated from the drainage device 180 only when the module door 220 is opened. FIG. 7 illustrates a case in which the filter 189 is separable from the drainage device 180 without opening the module door 220.

The detergent supply module 200 of FIG. 7 may further include a communication hole 228 formed to penetrate the module door 220 and arranged at a position corresponding to that of the filter 189, and a communication hole lid 229 to open and close the communication hole 228. To minimize a volume of the detergent supply module 200, the filter 189 may be positioned at the lower portion of the second container 233. The communication hole 228 may be arranged to penetrate the module door 220 positioned at the lower portion of the second container 233.

In this embodiment, the filter 189 may be exposed through the communication hole 228 when the communication hole lid 229 is separated from the module door 220. Accordingly, the user may separate the filter 189 from the drainage device 180 without opening the module door 220.

While the container 230 is illustrated as being detachably provided to, at, or in the module door 220, the container 230 may be detachably provided to, at, or in the module panel 210 or the cabinet 110. In the case that the container 230 is detachably provided to, at, or in the module panel 210, the accommodation frame 221 may be provided to, at, or in the module panel 210. However, in the case that the container 230 is detachably provided to, at, or in the cabinet 110, the lower installation surface 111*b* of the cabinet 110 may perform the function of the module panel 210, and the module panel 210 may be omitted. That is, the accommodation frame 221 and the detergent pumps 211 and 213 may be provided to, at, or in the lower installation surface 111*b* (or the cabinet 110), and the filter 189 may be detachably fixed to the lower installation surface 111*b*.

Further, the container 230 may be fixed to one of the module door 220, the module panel 210, or the cabinet 110. In the case that the container 230 is fixed to either the module door 220 or the module panel 210, the accommodation frame 221 may be omitted and the detergent pumps 211 and 213 may be respectively fixed to the containers 231 and 233. On the other hand, in the case that the container 230 is fixed to the cabinet 110, the module panel 210 may be omitted, and the container 230 may be fixed to the lower installation surface 111*b* of the cabinet 110. In this case, the accommodation frame 221 may be omitted, and the detergent pumps 211 and 213 may be respectively fixed to the containers 231 and 233.

The detergent pumps 211 and 213 provided to or for the detergent supply module 200 may have any shape which allows the detergent pumps 211 and 213 to supply the detergent stored in the container 230 to the tub 130 or the detergent storage module 190. That is, the detergent pumps 211 and 213 may move a fluid by rotation of an impeller, or move the fluid by inducing a change in cross-sectional area of the detergent supply channel (as in a peristaltic pump). Alternatively, the detergent pump may move the fluid by two gears rotating by being engaged with one another.

In addition, while the first detergent and the second detergent are illustrated as being supplied to the tub 130 through the first detergent supply conduit 212 and the second detergent supply conduit 214, the first detergent supply conduit and the second detergent supply conduit may be formed as one supply conduit. In this case, the supply conduit connected to the tub 130 or the detergent storage module 190 may be branched to be connected to the first detergent pump and the second detergent pump, and a valve may be provided at the branch point of the supply conduit.

Figure 8:
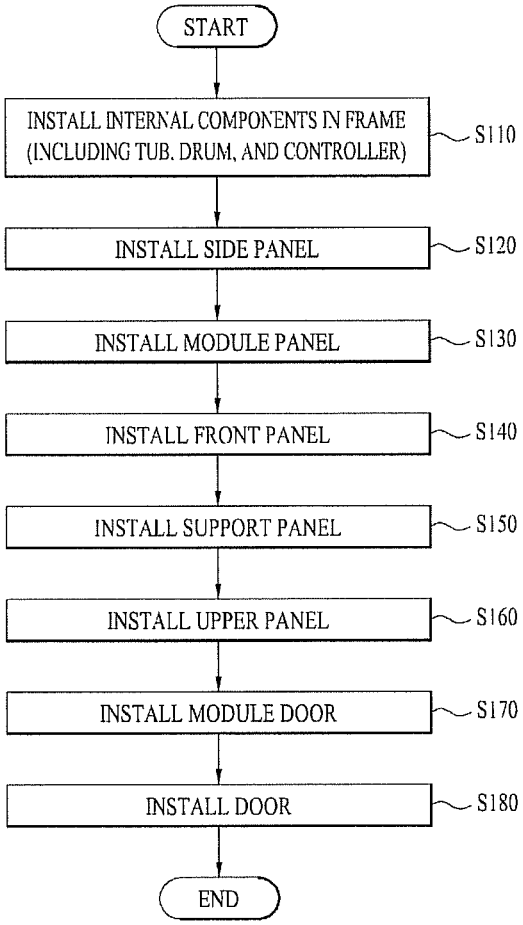
FIG. 8 is a flow chart of a process of assembling a detergent supply module and cabinet according to an embodiment.

Hereinafter, an assembly process of the first treating apparatus 100*a* will be described with reference to FIGS. 3 and 8. FIG. 8 is a flow chart of a process of assembling a detergent supply module and cabinet according to an embodiment. In the assembly process of the first treating apparatus 100*a*, first, the tub 130, the drum 140, a controller (not shown), and the drive device 170 may be installed in the frame 111, in step S110. Thereafter, the side panel 116 may be installed on or at both side surfaces of the frame 111, in step S120, and the module panel 210 may be fixed to the lower installation surface 111*b*, in step S130. Fixing the module panel 210 to the lower installation surface 111*b* may be performed with the detergent pumps 211 and 213, the drainage pump 185, and the drainage filter 189 pre-connected to the module panel 210 through a separate assembly process.

After assembly of the module panel 210 is completed, the front panel 112 may be coupled to the upper installation surface 111*a*, in step S140. In this case, the upper surface of the front panel 112 may be coupled to the upper installation surface 111*a*, and the lower surface of the front panel 112 may be fixed to the upper portion of the module panel 210 by a separate fastening means or fastener (not shown).

The reinforcement member 114 provided on both side surfaces of the front panel 112 may be fixed to the frame 111. In this case, the front panel 112 may be securely fixed to the frame 111 by the reinforcement member 114 and the inclination angle of the front panel 112 may be maintainable.

After installation of the front panel 112 is completed, the support panel 117 may be installed, in step S150. The support panel 117 may be fixed to the reinforcement member 114, or to the frame 111. The support panel 117 may close the space defined between the front panel 112 and the side panel 116.

After installation of the support panel 117, the upper panel 119 may be installed at the frame 111, in step S160. Installation of the tub 130, the drum 140, the drive 170, the water supply device 160, the drainage device 180, and the detergent storage module 190 in the frame 111 may be completed before installation of the upper panel 119. In addition, installation of the detergent supply conduits 212 and 214 provided between the detergent pumps 211 and 213 and the detergent storage module 190 may also be completed before installation of the upper panel 119.

Coupling of the module door 220 to the module panel 210, in step S170, may precede installation of the upper panel 119. Installing the module door 220, in step S170, may be performed by coupling the module panel 210 to the module door 220 through the hinge 227. Thereafter, the door 120 may be installed at the front panel 112, in step S180, and assembly of the first treating apparatus may be completed.

Figure 9:
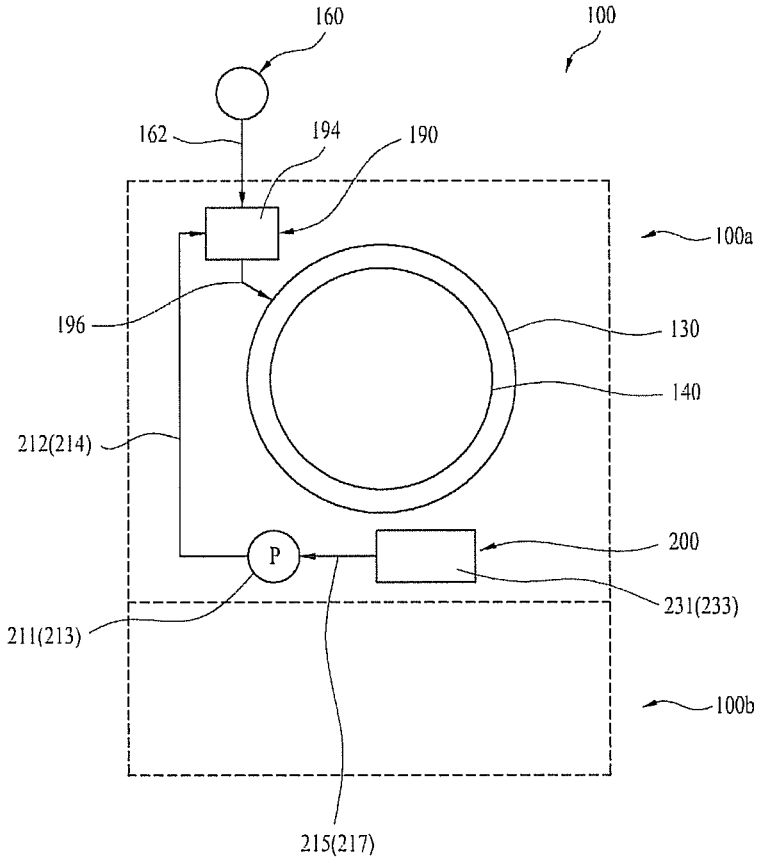
FIG. 9 is a schematic view of a flow channel through which detergent stored in a detergent supply module may be supplied to a tub.

Hereinafter, a process of supply of a detergent by the detergent supply module 200 will be described with reference to FIG. 9. FIG. 9 is a schematic view of a flow channel through which detergent stored in a detergent supply module may be supplied to a tub When the detergent pumps 211 and 213 operate, the detergents stored in the containers 231 and 233 may be supplied to the detergent pumps 211 and 213 through the pump connection conduits 215 and 217, and the detergents supplied to the detergent pumps 211 and 213 may be moved to the storage body 194 provided to, at, or in the detergent storage module 190 through the detergent supply conduits 212 and 214. As the storage body 194 communicates with the tub 130 through the tub supply conduit 196, the detergents moved from the detergent supply module 200 to the storage body 194 may be supplied to the tub 130.

In the above case, the detergents may not be stored in the detergent storage module 190. The user may supply a separate detergent to the storage body 194, if necessary. In this case, the detergent in the storage body 194 may be supplied to the tub 130 by the washing water supplied through the water supply device 160. The detergent supplied to the storage body 194 through the detergent supply module 200 may be supplied regardless of when the washing water is supplied. The detergent may be supplied to the storage body 194 before the washing water is supplied or at the same time as when the washing water is supplied.

In the case of the first treating apparatus 100*a* configured as shown in FIG. 9, the detergent supply conduits 212 and 214 may become clogged by the detergents. In the structures shown in FIG. 10, clogging of the detergent supply conduits 212 and 214 may be addressed.

Figure 10A:
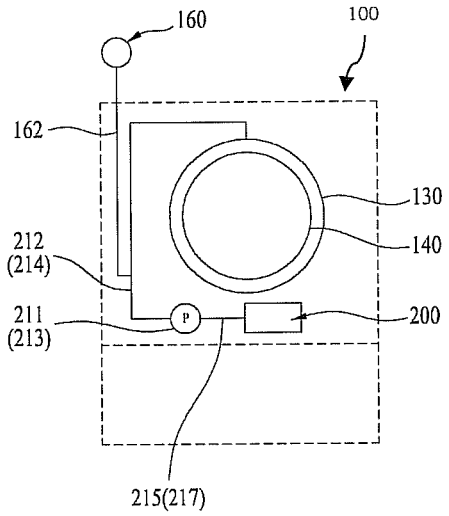
FIGS. 10A-10D and 11 are schematic views of a laundry treating apparatus that provides for rinsing of a detergent supply conduit according to an embodiment.

FIGS. 10A-10D and 11 are schematic views of a laundry treating apparatus that provides for rinsing of a detergent supply conduit according to an embodiment. FIG. 10A illustrates a structure that allows rinsing of the detergent supply conduits 212 and 214 in the case that the detergent storage module 190 is not provided. In this embodiment, the detergent supply conduits 212 and 214 may be arranged to connect the detergent pumps 211 and 213 to an upper surface of the tub 130, and the water supply device 160 may supply washing water to the tub 130 through the detergent supply conduits 212 and 214.

During the washing operation, the detergent and washing water may be typically supplied to the tub 130. Accordingly, by controlling the water supply device 160 and the detergent supply module 200 to perform supply of the detergent stored in the detergent storage module 200 upon or after supply of the washing water to the tub 130, the detergent may be prevented from clogging the detergent supply conduits 212 and 214.

Figure 10B:
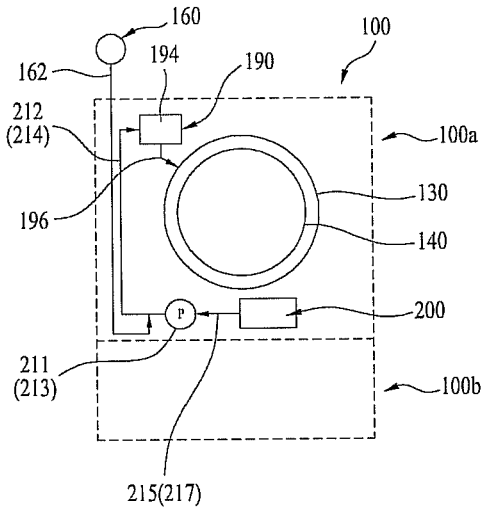
Figure 10C:
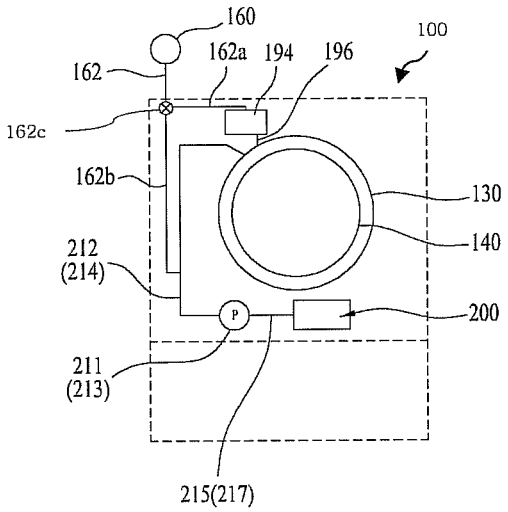
Figure 10D:
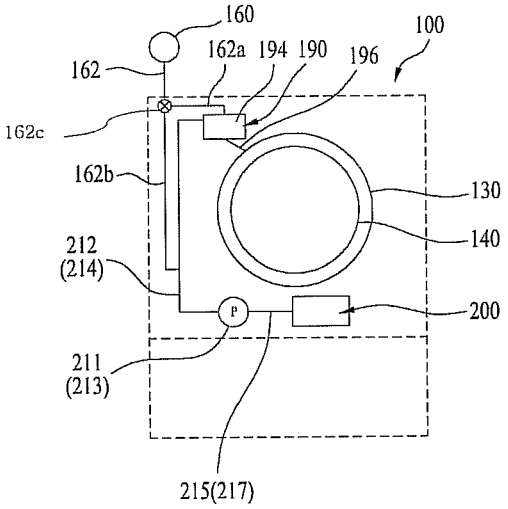

FIGS. 10B, 10C and 10D show structures that allow rinsing of the detergent supply conduits 212 and 214 in the case that the detergent storage module 190 is provided. In the embodiment shown in FIG. 10B, the detergent supply conduits 212 and 214 may be arranged to connect the detergent pumps 211 and 213 with the storage body 194. In this embodiment, the washing water supplied from the water supply device 160 may always be supplied to the tub 130 via the detergent supply conduits 212 and 214 and the storage body 194. Accordingly, it may be possible to supply the detergent stored in the detergent storage module 190 to the tub 130 and prevent the detergent from clogging the detergent supply conduits 212 and 214.

In the embodiment shown in FIG. 10C, the water supply channel 162 provided to or at the water supply device 160 may include a first water supply channel 162*a* to supply washing water to the storage body 194 and a second water supply channel 162*b* to supply washing water to the detergent supply conduits 212 and 214. The first water supply channel 162*a* and the second water supply channel 162*b* may be branched from one channel 162, and a valve 162*c* may be provided at the branch point of each channel.

The detergent stored in the detergent storage module 190 may be supplied to the tub 130 by the washing water supplied to the storage body 194 through the first water supply channel 162*a*. The detergent stored in the detergent supply module 200 may be supplied to the tub 130 through the detergent supply conduits 212 and 214 during operation of the detergent pumps 211 and 213.

The detergents remaining in the detergent supply conduits 212 and 214 may be discharged to the tub 130 by the washing water supplied through the second water supply channel 162*b*. The rinsing of the detergent supply conduits as discussed above may be performed every time the detergent pumps 211 and 213 supply the detergents through the detergent supply conduits 212 and 214, or may be performed when a number of operations of the detergent pumps 211 and 213 reaches a predetermined reference number.

In the embodiment shown in FIG. 10D, the detergent supply conduits 212 and 214 may be arranged to connect the detergent pumps 211 and 213 to the storage body 194. The water supply device 160 may include the first water supply channel 162*a* to supply washing water to the storage body 194 and the second water supply channel 162*b* to supply washing water to the detergent supply conduits 212 and 214. In this embodiment, the first water supply channel 162*a* and the second water supply channel 162*b* may be branched from one channel 162, and may be provided with a valve 162*c* at the branch point. The detergent stored in the detergent storage module 190 may be supplied to the tub 130 when the first water supply channel 162*a* is opened by the valve. The detergent stored in the detergent supply module 200 may be supplied to the tub 130 through the detergent supply conduits 212 and 214, the storage body 194, and the tub supply conduit 196 when the detergent pumps 211 and 213 operate.

The detergents remaining in the detergent supply conduits 212 and 214 may be discharged to the tub 130 when the washing water is supplied to the second water supply channel 162*b* by the valve 162*c*. Rinsing of the detergent supply conduits may be performed every time the detergent pumps 211 and 213 operate as discussed above, or may be performed when a number of operations of the detergent pumps reaches a predetermined reference number.

In the first treating apparatus 100*a* having the structure shown in FIGS. 10A-10D, the channel 162*b* (the channel 162 in FIG. 10A) for supply of washing water to the detergent supply conduits 212 and 214 may be arranged to supply the washing water to the detergent pumps 211 and 213 (to rinse an interior of the detergent pumps), or may be arranged to supply the washing water to discharge ports of the detergent pumps.

The first treating apparatus 100*a* according to embodiments may rinse not only the detergent supply conduits 212 and 214, but also the container 230. In this case, the detergent pumps 211 and 213 may move the washing water toward the detergent supply conduits 212 and 214 or toward the pump connection conduits 215 and 217.

In the case of the first treating apparatus 100*a* having the structure shown in FIG. 9, rinsing of the container 230 may be performed as the detergent pumps 211 and 213 supply the washing water introduced into the detergent supply conduits 212 and 214 through the detergent storage module 190 to the container 230. The washing waster stored in the container 230 may be discharged to the tub 130 through the detergent supply conduits 212 and 214 by the detergent pumps 211 and 213.

The washing water may be discharged from the container 230 to the outside through a branch channel branched from the detergent supply conduits 212 and 214 to allow the interior of the container to communicate with the exterior of the cabinet.

Figure 11:
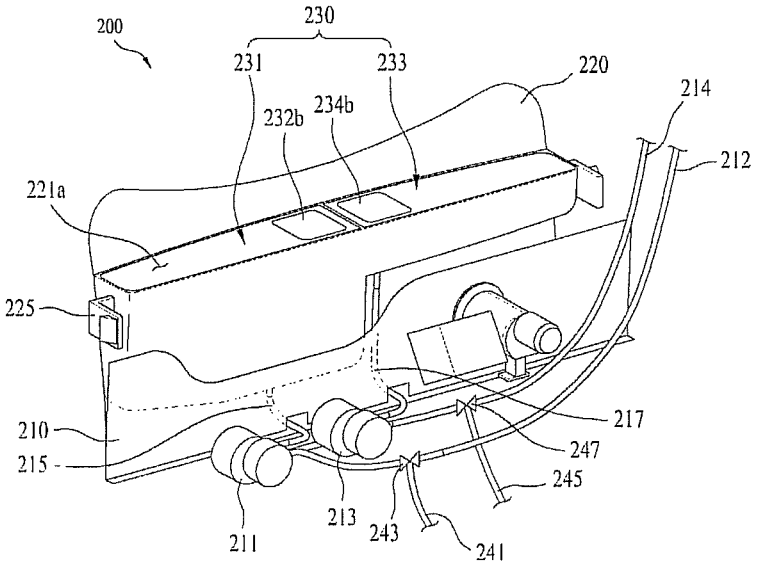

As shown in FIG. 11, the branch channel may be provided with a first branch conduit 241 that allows the first detergent supply conduit 212 to communicate with an exterior of the cabinet 110, that is, the second drainage channel 183, therethrough, and a second branch conduit 245 that allows the second detergent supply conduit 214 to communicate with the exterior of the cabinet 110. The first branch conduit 241 may be provided with a first branch conduit valve 243, and the second branch conduit 245 may be provided with a second branch conduit valve 247. The first branch conduit valve 243 and the second branch conduit valve 247 may close the branch conduits 241 and 245 when the detergent in the container is supplied to the detergent storage module 190 or the tub 130, and open the branch conduits 241 and 245 only when the container is rinsed.

In this embodiment, the rinsing water may be supplied to the detergent pumps 211 and 213 through the detergent storage module 190 and the detergent supply conduits 212 and 214. Alternatively, rinsing water may be directly supplied to the detergent pumps 211 and 213 from the water supply source. That is, a separate channel for supply of rinsing water may be further provided between the water supply source and the detergent pumps 211 and 213.

In the case of the first treating apparatus 100*a* having the structure shown in FIGS. 10A-10D, rinsing of the container 230 may be performed through supply of the washing water supplied to the detergent supply conduits 212 and 214 through the water supply device 160 to the container 230 through the pump connection conduits 215 and 217 by the detergent pumps 211 and 213, and discharge of the washing water supplied to the container 230 toward the detergent supply conduits 212 and 214 by the detergent pumps 211 and 213. The washing water may be discharged from the container 230 to the outside through the branch channel of FIG. 11.

The first treating apparatus 100*a* shown in FIGS. 10A-10D may be controlled to perform a detergent supply step of supplying the liquid detergent in the container 230 to the tub through the detergent pumps 211 and 213 to rinse both the detergent supply conduits 212 and 214 and the container 230, a supply conduit rinsing step of supplying water to the detergent supply conduits 212 and 214 through the water supply device 160 and discharging the liquid detergent remaining in the detergent supply conduits 212 and 214, and a container rinsing step of supplying water to the container 230 through the water supply device 160 and rinsing the interior of the container.

The supply conduit rinsing step may be implemented when the detergent supply step is performed a predetermined reference number of times. The container rinsing step may be provided with a first rinsing step of supplying water to the detergent supply conduits 212 and 214 through the water supply device 160, a second rinsing step of supplying water supplied to the detergent supply conduits 212 and 214 through the detergent pumps 211 and 213 to the container 230, and a third rinsing step of discharging the water stored in the container 230 through the detergent pumps 211 and 213.

The detergent supply step may be performed by rotating the respective impellers of the detergent pumps 211 and 213 in a first direction (the direction in which the liquid in the container is discharged). The second rinsing step may be performed by rotating the respective impellers in a second direction (the direction in which the liquid is supplied into the container) opposite to the first direction, and the third rinsing step may be performed by rotating the respective impellers in the first direction. The third rinsing step may be performed such that the water in the container 230 may be discharged to the tub 130 through the detergent supply conduits 214 and 212. Alternatively, the third rinsing step may be performed such that the water in the container 230 is discharged to the outside of the tub 130 through the branch channels 241, 243, 245 and 247 branched from the detergent supply conduits 212 and 21 to allow the interior of the container 230 to communicate with the exterior of the cabinet 110 therethrough.

Embodiments disclosed herein have at least the following advantages.

With embodiments disclosed herein, a position of a space to store a detergent may be lowered, and therefore, inconvenience associated with conventional laundry treating apparatuses may be addressed. In addition, in a laundry treating apparatus according to embodiments disclosed herein, a position of a space to store a detergent may be lowered and a detergent supply module may be provided. Accordingly, stored detergent may be easily supplied to the laundry.

Further, according to embodiments disclosed herein, a flow channel, through which detergent may be supplied from a detergent supply module to the space in which laundry is contained may be rinsed and thus clogging of the flow channel may be prevented. Furthermore, according to embodiments disclosed herein, a constant amount of detergent stored in a detergent supply module may be supplied to the space where the laundry is contained when the laundry is washed.

Embodiments disclosed herein provide a laundry treating apparatus in which a position of a space to store a detergent is lowered to address user inconvenience with conventional laundry treating apparatuses.

Embodiments disclosed herein further provide a laundry treating apparatus which may include a space to store a detergent at a lowered position and a detergent supply module to facilitate supply of the stored detergent to laundry.

Embodiments disclosed herein provide a laundry treating apparatus which may rinse a flow channel through which the detergent may be supplied from a detergent supply module to a space in which the laundry is contained and prevent clogging of the flow channel.

Embodiments disclosed herein further provide a laundry treating apparatus which may supply a constant amount of detergent stored in a detergent supply module to the space in which the laundry is contained when the laundry is washed.

Embodiments disclosed herein provide a laundry treating apparatus that may include a cabinet provided with an opening that communicates with an outside of the cabinet and an introduction port for introduction of laundry, a tub arranged in the cabinet and provided with a tub introduction port that communicates with the introduction port, and a detergent supply module that provides a space to store a detergent and adapted to provide the stored detergent to the tub, the detergent supply module being detachably provided to the opening. The detergent supply module may include a module door provided to the opening to define a front surface of the cabinet, and a container provided in the cabinet to store a detergent therein and positioned on a rear surface of the module door.

The detergent supply module may further include a module panel having a detergent pump fixed thereto and coupled to the opening, the detergent pump being adapted to move the detergent in the container to the tub. The container may be provided to one of the module door or the module panel. The detergent supply module may further include an accommodation frame provided on one of the module door or the module panel to allow the container to be fixed thereto. The detergent supply module may further include an accommodation frame provided to one of the module door or the module panel to allow the container to be detachably accommodated therein.

The detergent supply module may further include a detergent discharge conduit to discharge the detergent stored in the container to the accommodation frame when the container is inserted into the accommodation frame, a pump connection conduit to connect an interior of the accommodation frame with the detergent pump, and a detergent supply conduit to guide the detergent discharged from the detergent pump to an upper surface of the tub. The laundry treating apparatus may further include a detergent storage module positioned at an upper portion of the introduction port to communicate with the tub and store a detergent therein, and a water supply unit or device to supply washing water to the detergent storage module to introduce the detergent stored in the detergent storage module into the tub. The detergent supply module may further include a detergent discharge conduit to discharge the detergent stored in the container to the accommodation frame when the container is inserted into the accommodation frame, a pump connection conduit to connect an interior of the accommodation frame with the detergent pump, and a detergent supply conduit to guide the detergent discharged from the detergent pump to the detergent storage module.

The opening may be positioned at a lower portion of the introduction port, and the module door may be rotatably coupled to a front surface of the module panel. The accommodation frame may be provided to the module door, and the container may be detachably provided to the accommodation frame. The detergent pump may be fixed to a rear surface of the module panel, and the pump connection conduit may penetrate the module panel to connect the detergent pump with the accommodation frame. The module panel may further include a connection conduit hole penetrated by the pump connection conduit, and a holder provided to the connection conduit hole to prevent the pump connection conduit and the detergent pump from being separated from each other.

The laundry treating apparatus may further include a drainage channel to discharge washing water stored in the tub to the outside of the cabinet, and a filter detachably provided to the drainage channel to filter the washing water and supported by the module panel. The module panel may include a filter attachment hole that allows the filter to be detachably accommodated therein.

The opening may be positioned at a lower portion of the introduction port, and the module door may be rotatably coupled to the module panel. The module door may be rotatable to a first angle and a second angle, the container being exposed at the first angle and the filter being exposed at the second angle. The laundry treating apparatus may further include a damper to adjust an angle of rotation of the module door.

According to embodiments disclosed herein, a position of a space to store a detergent may be lowered, and therefore, inconvenience associated with conventional laundry treating apparatuses may be addressed.

In addition, in a laundry treating apparatus according to embodiments disclosed herein, the position of the space to store detergent may be lowered and a detergent supply module may be provided. Accordingly, the stored detergent may be easily supplied to the laundry. Further, according to embodiments, a flow channel, through which the detergent may be supplied from a detergent supply module to the space where the laundry is contained, may be rinsed, and thus, clogging of the flow channel may be prevented.

Furthermore, according to embodiments, a constant amount of detergent stored in a detergent supply module may be supplied to the space in which the laundry is contained when the laundry is washed.

It will be apparent to those skilled in the art that various modifications and variations can be made without departing from the spirit or scope. Thus, it is intended that the embodiments cover the modifications and variations provided they come within the scope of the appended claims and their equivalents.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treating apparatus, comprising:

a cabinet having an introduction port for introduction of laundry and an opening that communicates with an outside of the cabinet;

a tub arranged in the cabinet and provided with a tub introduction port that communicates with the introduction port;

a drainage channel to discharge washing water stored in the tub outside of the cabinet;

a filter detachably provided in the drainage channel to filter the washing water;

a first detergent supply module to store a first detergent and provide the stored first detergent to the tub, the first detergent supply module being detachably provided at the opening, wherein the first detergent supply module includes:

a module panel coupled to the opening;

a module door provided at the opening and rotatably coupled to the module panel to define a front surface of the cabinet;

at least one container provided in the cabinet to store the first detergent therein and positioned at a rear surface of the module door; and at least one detergent pump fixed to the module panel to move the first detergent stored in the at least one container to the tub, wherein the filter is supported by the module panel and withdrawable through the opening when the module door opens the opening.

2. The laundry treating apparatus according to claim 1, wherein the at least one container is provided at one of the module door or the module panel.

3. The laundry treating apparatus according to claim 2, wherein the first detergent supply module further includes an accommodation frame provided on one of the module door or the module panel to receive the at least one container to be fixed thereto.

4. The laundry treating apparatus according to claim 2, wherein the first detergent supply module further includes an accommodation frame provided at one of the module door or the module panel to allow the at least one container to be detachably accommodated therein.

5. The laundry treating apparatus according to claim 4, wherein the first detergent supply module further includes:

at least one detergent discharge conduit to discharge the first detergent stored in the at least one container to the accommodation frame when the at least one container is inserted into the accommodation frame;

at least one pump connection conduit to connect an interior of the accommodation frame with the detergent pump; and at least one detergent supply conduit to guide the first detergent discharged from the at least one detergent pump to an upper surface of the tub.

6. The laundry apparatus according to claim 1, wherein the first detergent supply module is positioned below a lower portion of the introduction port.

7. The laundry treating apparatus according to claim 6, further including:

a second detergent storage module positioned above an upper portion of the introduction port to communicate with the tub and store a second detergent therein; and a water supply device to supply washing water to the second detergent storage module to introduce the second detergent stored in the second detergent storage module into the tub.

8. The laundry treating apparatus according to claim 7, wherein the first detergent supply module further includes:

at least one detergent discharge conduit to discharge the first detergent stored in the container to the accommodation frame when the container is inserted into the accommodation frame;

at least one pump connection conduit to connect an interior of the accommodation frame with the at least one detergent pump; and at least one detergent supply conduit to guide the first detergent discharged from the at least one detergent pump to the second detergent storage module.

9. The laundry treating apparatus according to claim 8, wherein the module door is rotatably coupled to a front surface of the module panel, wherein the accommodation frame is provided on the module door, and wherein the container is detachably provided on the accommodation frame.

10. The laundry treating apparatus according to claim 9, wherein the at least one detergent pump is fixed to a rear surface of the module panel, and wherein the at least one pump connection conduit penetrates the module panel to connect the at least one detergent pump with the accommodation frame.

11. The laundry treating apparatus according to claim 9, wherein the module panel further includes:

a connection conduit hole configured to receive the at least one pump connection conduit to penetrate therethrough; and a holder provided in the connection conduit hole to prevent the at least one pump connection conduit and the at least one detergent pump from being separated from each other.

12. The laundry treating apparatus according to claim 1, wherein the module panel includes a filter attachment hole that receives the filter detachably accommodated therein.

13. The laundry treating apparatus according to claim 12, wherein the opening is positioned below a lower portion of the introduction port, and wherein the module door is rotatably coupled to the module panel.

14. The laundry treating apparatus according to claim 13, wherein the module door is rotatable to a first angle and a second angle, the at least one container being exposed at the first angle and the filter being exposed at the second angle.

15. The laundry treating apparatus according to claim 14, further including a damper to adjust an angle of rotation of the module door.

16. The laundry treating apparatus according to claim 1, wherein the at least one container includes a plurality of containers configured to store different types of first detergent.

17. The laundry treating apparatus according to claim 16, wherein the first detergent supply module further includes an accommodation frame provided on one of the module door or the module panel to receive the plurality of containers to be fixed thereto.

18. The laundry treating apparatus according to claim 17, wherein the first detergent supply module further includes:

a plurality of detergent discharge conduits to discharge the first detergents stored in the plurality of containers to the accommodation frame when the plurality of containers is inserted into the accommodation frame;

a plurality of pump connection conduits to connect an interior of the accommodation frame with a plurality of detergent pumps; and a plurality of detergent supply conduits to guide the first detergents discharged from the plurality of detergent pumps to an upper surface of the tub.

19. The laundry treating apparatus according to claim 1, wherein the cabinet includes a front panel that extends at an angle with respect to a central longitudinal axis of the cabinet, the introduction port being disposed within the front panel, and wherein the opening is disposed below the introduction port.

20. A laundry treating apparatus, comprising:

a cabinet having an introduction port for introduction of laundry and an opening that communicates with an outside of the cabinet disposed below the introduction port;

a tub arranged in the cabinet and provided with a tub introduction port that communicates with the introduction port;

a drainage channel to discharge washing water stored in the tub outside of the cabinet;

a filter detachably provided in the drainage channel to filter the washing water; and a first detergent supply module to store a first detergent and provide the stored first detergent to the tub, the first detergent supply module being detachably provided at the opening, wherein the first detergent supply module includes:

a module panel coupled to the opening;

a module door provided at the opening and rotatably coupled to the module panel to define a front surface of the cabinet;

at least one container provided in the cabinet to store the first detergent therein and positioned at a rear surface of the module door; and at least one detergent pump fixed to the module panel to move the first detergent stored in the at least one container to the tub, wherein the filter is supported by the module panel and withdrawable through the opening when the module door opens the opening.

21. The laundry treating apparatus according to claim 20, wherein the at least one container includes a plurality of containers configured to store different types of first detergent.

22. The laundry treatment apparatus according to claim 20, wherein the cabinet includes a front panel that extends at an angle with respect to a central longitudinal axis of the cabinet, the introduction port being disposed within the front panel.

23. The laundry treatment apparatus according to claim 20, further including:

a second detergent storage module positioned above an upper portion of the introduction port to communicate with the tub and store a second detergent therein.

24. The laundry treatment apparatus according to claim 23, further including:

a water supply device to supply washing water to the second detergent storage module to introduce the second detergent stored in the detergent storage module into the tub.

* * * * *